US012180866B1

(12) United States Patent
Opipari et al.

(10) Patent No.: US 12,180,866 B1
(45) Date of Patent: Dec. 31, 2024

(54) ENGINE VALVETRAIN DEACTIVATION SYSTEM WITH SWITCHABLE ROCKER ARM CAM LIFT

(71) Applicant: GM GLOBAL TECHNOLOGY OPERATIONS LLC, Detroit, MI (US)

(72) Inventors: Anteo Carl Opipari, Saugatuck, MI (US); Paul Austin, Rockford, MI (US); Brian Joseph Warner, Hudsonville, MI (US); Rolando Huerta Ortiz, Grandville, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 18/662,889

(22) Filed: May 13, 2024

(51) Int. Cl.

| | |
|---|---|
| ***F01L 13/00*** | (2006.01) |
| ***F01L 1/18*** | (2006.01) |
| ***F01L 1/46*** | (2006.01) |
| ***F01L 9/10*** | (2021.01) |
| *F01L 1/047* | (2006.01) |

(52) U.S. Cl.
CPC ..... *F01L 13/0005* (2013.01); *F01L 1/181* (2013.01); *F01L 1/46* (2013.01); *F01L 9/10* (2021.01); *F01L 1/047* (2013.01); *F01L 2001/467* (2013.01); *F01L 2013/001* (2013.01)

(58) Field of Classification Search
CPC ... F01L 1/047; F01L 1/181; F01L 1/46; F01L 2001/467; F01L 13/0005; F01L 2013/001
USPC ..... 123/90.39
See application file for complete search history.

(56) References Cited

U.S. PATENT DOCUMENTS

| | | | | |
|---|---|---|---|---|
| 7,503,296 | B2 | 3/2009 | Rozario et al. | |
| 8,495,993 | B2 | 7/2013 | Rice et al. | |
| 2010/0186701 | A1* | 7/2010 | Hicks | F01L 13/0005 123/90.55 |
| 2012/0118274 | A1 | 5/2012 | Keating | |
| 2016/0123193 | A1* | 5/2016 | Patterson | F01L 1/146 123/90.16 |
| 2018/0363519 | A1* | 12/2018 | Radulescu | F01L 13/0036 |
| 2022/0213820 | A1* | 7/2022 | Van Wingerden | F01L 13/0005 |
| 2022/0307389 | A1* | 9/2022 | Edke | F01L 13/065 |
| 2023/0235685 | A1* | 7/2023 | Raimondi | F01L 13/0005 123/90.39 |

* cited by examiner

*Primary Examiner* — Jorge L Leon, Jr.
(74) *Attorney, Agent, or Firm* — Lorenz & Kopf LLP

(57) ABSTRACT

A cylinder deactivation system for an engine includes an engine block defining a cylinder. A valve opens and closes a port to the cylinder. A rocker arm pivots to operate the valve. A camshaft has a cam lift and a cam-to-rocker input system transfers the cam lift through the rocker arm to the valve. A deactivation assembly is disposed in the rocker arm and is responsive to fluid pressure to alternately effect an activated state of the valve and a deactivated state of the valve.

20 Claims, 4 Drawing Sheets

ENGINE VALVETRAIN DEACTIVATION SYSTEM WITH SWITCHABLE ROCKER ARM CAM LIFT

INTRODUCTION

The present disclosure generally relates to internal combustion engine systems with valvetrains that have rocker arms, and more particularly relates to engine valvetrain systems that include a captured cam lobe lift at the cam input to rocker arm interface to alternately activate and deactivate individual cylinders of the engine.

Internal combustion engine applications, such as in vehicles, may include cylinder deactivation where one or more of multiple cylinders in the engine is disabled, effectively reducing the engine's size. For Spark ignition engines where the load is, at least partially, controlled by the intake throttle valve position the intake throttle valve may be opened further to produce the same work at the engine crankshaft when some of the cylinders are deactivated. This increased throttle opening reduces the pumping loop loss in a typical 4 cycle engine, thereby increasing the overall efficiency. For a diesel engine, whose load is primarily controlled by the amount of fuel injected during the engine cycle, the pumping loop loss caused by a partially closed throttle is not normally an efficiency limitation. For a diesel engine a benefit of cylinder deactivation is the ability to quickly increase the temperature of the exhaust catalyst. This is done by increasing the load in the cylinders which remain active by increasing the amount of fuel injected to produce the same work at the crankshaft when some cylinders are deactivated. Ultimately this will result in an increased temperature in the exhaust catalyst for a given engine crankshaft output. A higher temperature catalyst can be utilized to improve overall engine emissions. The same methodology can be used to more quickly heat up the catalyst with consequent improvement in emissions. Deactivation may be implemented on any number of the cylinders of an engine providing any number of select variations of active cylinder displacement.

Valvetrain deactivation may require substantial alterations to the base engine and therefore may be complex to implement. For example, many of the components of the engine may require modification. In addition, substantial lash may result in the valvetrain system which may negatively impact engine efficiency.

Accordingly, it is desirable to provide cylinder deactivation systems that require a minimum amount of changes to engine components and that result in optimized engine efficiency. Furthermore, other desirable features and characteristics will become apparent from the subsequent detailed description and the appended claims, taken in conjunction with the accompanying drawings and the foregoing introduction.

SUMMARY

Cylinder deactivation systems are provided with rocker arm features that effect selective deactivation of cylinders of an engine. In a number of embodiments, a cylinder deactivation system for an engine includes an engine block defining a cylinder. A valve opens and closes a port to the cylinder. A rocker arm pivots to operate the valve. A camshaft has a cam lift and a cam-to-rocker input system transfers the cam lift through the rocker arm to the valve. A deactivation assembly is disposed in the rocker arm and is responsive to fluid pressure to alternately effect an activated state of the valve or a deactivated state of the valve.

In additional embodiments, the rocker arm defines a bore. The deactivation assembly includes a pin housing disposed in the bore and a lock pin in the pin housing. The lock pin acts to alternately lock and unlock the pin housing relative to the rocker arm in response to the fluid pressure.

In additional embodiments, the deactivation assembly includes a deactivation spring in the rocker arm and the valve is biased to a closed position by a valve spring. The valve spring applies a force to the valve and the deactivation spring applies a force in the deactivation assembly. The force of the valve spring is greater than the force of the deactivation spring so that the valve spring maintains the valve in a closed state while the deactivation spring is compressed in the deactivated state of the valve.

In additional embodiments, the rocker arm defines a bore. The lock housing is disposed in the bore and defines a cross bore. A pin housing is disposed in the bore and within the lock housing. The pin housing is a part of the deactivation assembly and defines a lock pin cavity that registers with the cross bore. A lock pin is disposed in the lock pin cavity. A pump is operable to supply fluid pressure to the cross bore to force the lock pin into the lock pin cavity.

In additional embodiments, the rocker arm defines a bore. A lock housing is disposed in the bore and defines a cross bore. A pin housing is disposed in the bore within the lock housing. The pin housing is a part of the deactivation assembly and defines a lock pin cavity. A lock pin is disposed in the lock pin cavity. A lock pin spring in the lock pin cavity forces the lock pin toward the cross bore. The fluid pressure operates to compress the lock pin spring in the deactivated state of the valve.

In additional embodiments, the rocker arm defines a bore and a pin housing is disposed in the bore. The pin housing is a part of the deactivation assembly and defines a lock pin cavity. A lock pin is disposed in the lock pin cavity and has a slot. The lock pin retainer has a stem engaged in the slot.

In additional embodiments, the rocker arm defines a bore and a pin housing is disposed in the bore. The pin housing is a part of the deactivation assembly and defines a lock pin cavity. A lock pin is disposed in the lock pin cavity. An oil gallery opens to the lock pin cavity to relieve pressure from the lock pin cavity.

In additional embodiments, the rocker arm defines a bore and a pin housing is disposed in the bore. The pin housing is a part of the deactivation assembly and defines a lock pin cavity. A lock pin is disposed in the lock pin cavity. A deactivation spring is disposed in the bore and operates to apply a force to the pin housing.

In additional embodiments, the rocker arm defines a bore. A lock housing is disposed in the bore and defines a cross bore with an undercut. A pin housing is disposed in the bore and within the lock housing. The pin housing is a part of the deactivation assembly and defines a lock pin cavity. A lock pin is disposed in the lock pin cavity. A lock pin spring forces the lock pin into the undercut of the cross bore to effect the activated state of the valve.

In additional embodiments, the rocker arm defines a bore. A pin housing is disposed in the bore. The pin housing is a part of the deactivation assembly and defines a seat engaged by the cam-to-rocker input system. A deactivation spring is disposed in the bore of the rocker arm. During the deactivated state, the deactivation spring compresses and expands to effect a lost motion effect so that the valve does not open.

In a number of other embodiments, a cylinder deactivation system for an engine includes an engine block defining a cylinder. A valve operates for opening and closing a port to the cylinder. A rocker arm pivots to operate the valve. A camshaft has a cam lift. A cam-to-rocker input system operates to transfer the cam lift through the rocker arm to the valve. A deactivation assembly is disposed in the rocker arm and is responsive to fluid pressure to alternatively effect an activated state of the valve and a deactivated state of the valve. The deactivation assembly includes a lock pin to lock and unlock the rocker arm from pivoting.

In additional embodiments, the rocker arm defines a bore and the deactivation assembly includes a pin housing disposed in the bore and a lock pin in the pin housing. The lock pin operates to alternately effect the lock and unlock of the rocker arm by locking and unlocking the pin housing relative to the rocker arm in response to the fluid pressure.

In additional embodiments, the deactivation assembly includes a deactivation spring disposed in the rocker arm. The valve is biased to a closed position by a valve spring. The valve spring applies a first force to the valve. The deactivation spring applies a second force inside the deactivation assembly. The first force is greater than the second force so that the valve spring maintains the valve in a closed state while the deactivation spring is compressed in the deactivated state of the valve.

In additional embodiments, the rocker arm defines a bore; and a lock housing in the bore. The lock housing defines a cross bore and the rocker arm defines a fluid chamber that registers with the cross bore. A pin housing is disposed in the bore and within the lock housing. The pin housing is a part of the deactivation assembly and defines a lock pin cavity that registers with the cross bore. A lock pin is disposed in the lock pin cavity. A pump operates to supply fluid pressure through the fluid chamber to the cross bore to force the lock pin into the lock pin cavity. A fluid control valve operates to control delivery of the fluid pressure to the cross bore.

In additional embodiments, the rocker arm defines a bore. A lock housing is disposed in the first bore and defines a cross bore. A pin housing is disposed in the bore within the lock housing. The pin housing is a part of the deactivation assembly and defines a lock pin cavity. A lock pin is disposed in the lock pin cavity. A lock pin spring in the lock pin cavity operates to force the lock pin toward the cross bore. The fluid pressure acts to compress the lock pin spring in the deactivated state of the valve.

In additional embodiments, the rocker arm defines a bore and a pin housing is disposed in the bore. The pin housing is a part of the deactivation assembly and defines a lock pin cavity. The lock pin is disposed in the lock pin cavity and has a slot. A lock pin retainer has a retaining stem engaged in the slot. An oil gallery extends through the retaining stem.

In additional embodiments, the rocker arm defines a bore and a pin housing is disposed in the bore. The pin housing is a part of the deactivation assembly and defines a lock pin cavity. A lock pin is disposed in the lock pin cavity. An oil gallery opens to the lock pin cavity and through the pin housing to relieve pressure from the lock pin cavity.

In additional embodiments, the rocker arm defines a bore and a pin housing is disposed in the bore. The pin housing is a part of the deactivation assembly and defines a lock pin cavity. A lock pin is disposed in the lock pin cavity. A lock pin spring is disposed in the lock pin cavity. A deactivation spring is disposed in the bore and operates to apply a force to the pin housing.

In additional embodiments, the rocker arm defines a bore and a lock housing is disposed in the bore. The lock housing defines a cross bore that has an undercut. A pin housing is disposed in the bore and within the lock housing. The pin housing is a part of the deactivation assembly and defines a lock pin cavity. A lock pin is disposed in the lock pin cavity. A lock pin spring operates to force the lock pin into the undercut of the cross bore to effect the activated state of the valve. A lock pin retainer has a stem engaging the lock pin.

In a number of additional embodiments, a cylinder deactivation system for an engine includes an engine block defining a cylinder. A valve operates for opening and closing a port to the cylinder. A rocker arm pivots to operate the valve and defines a bore. A camshaft has a cam lift. A cam-to-rocker input system operates to transfer the cam lift through the rocker arm to the valve. A deactivation assembly is disposed in the rocker arm and is responsive to fluid pressure to alternately effect an activated state of the valve and a deactivated state of the valve. The deactivation assembly includes a lock pin to lock and unlock the rocker arm from pivoting. The deactivation assembly includes a deactivation spring disposed in the bore of the rocker arm. During the deactivated state, the deactivation spring operates to compress and expand to effect a lost motion effect so that the valve does not open.

BRIEF DESCRIPTION OF THE DRAWINGS

The exemplary embodiments will hereinafter be described in conjunction with the following drawing figures, wherein like numerals denote like elements, and wherein.

DETAILED DESCRIPTION

The following detailed description is merely exemplary in nature and is not intended to limit the application and uses. Furthermore, there is no intention to be bound by any expressed or implied theory presented in the preceding introduction, brief summary or the following detailed description.

Figure 1:
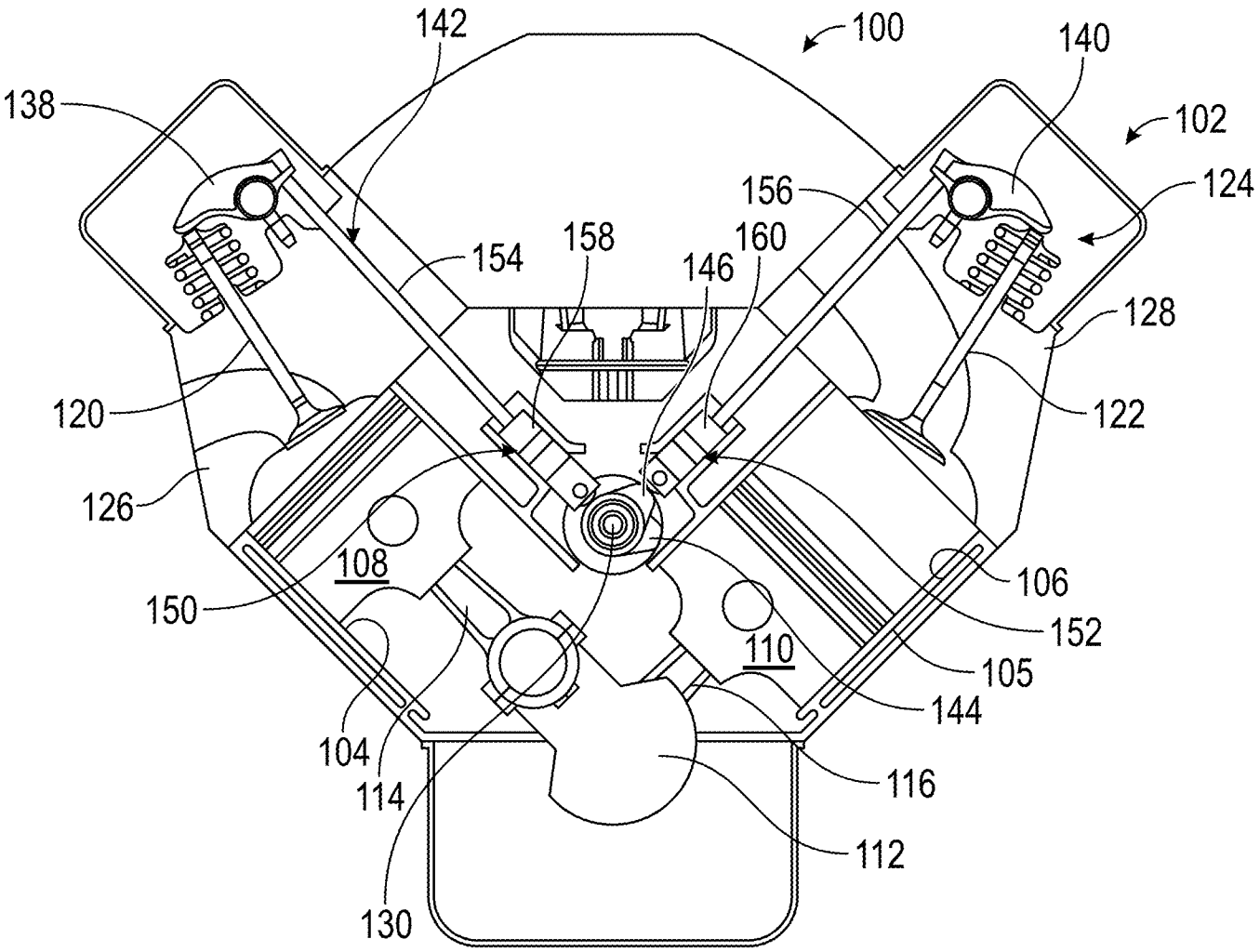
FIG. 1 is a schematic, partially sectioned illustration of an engine with a valvetrain deactivation system, in accordance with an embodiment.

With reference to FIG. 1, illustrated is an engine 100 with a cylinder deactivation system 102. The engine 100 may include a block 105 defining a number of cylinders, such as cylinders 104 and 106. Pistons 108, 110 are disposed within their respective cylinder 104, 106. A crankshaft 112 is disposed in the engine 100. Connecting rods 114, 116 connect their respective piston 108, 110 to the crankshaft 112. A number of valves such as an intake valve 120 and an exhaust valve 122 are associated with the cylinders 104, 106 in a valve system 124. The engine 100 includes cylinder heads 126, 128 coupled to the engine block 105. The engine block 105 may define a V-configuration having banks of cylinders including the cylinders 104, 106 disposed at an angle relative to one another. However, it is understood that the present disclosure is not limited to engines of the V-configuration, but is applicable to other types of engines, such as in-line, opposed cylinder, etc. It will be appreciated that each cylinder of the engine 100 will have at least an intake valve and an exhaust valve.

The valve system 124 may include a camshaft 130, the intake and exhaust valves 120, 122, rocker arms, 138, 140, a cam-to-rocker input system 142, and the cylinder deactivation system 102. The camshaft 130 may include a number of lobes such as intake and exhaust lobes 144, 146. The cam-to-rocker input system 142 may be engaged with the intake and exhaust lobes 144, 146 and the rocker arms 138, 140 to move the rocker arms 138, 140 and to open the intake and exhaust valves 120, 122. The cam to rocker input system 142 may also be referred to as a cam effector because it effects the lift of the camshaft 130 at the rocker arm 138, 140 and at the intake and exhaust valves 120, 122. The cam-to-rocker input system 142 may include valve lift mechanisms 150, 152 to transmit inputs from the intake and exhaust lobes 144, 146 to the rocker arms 138, 140. The valve lift mechanisms 150, 152 may each include a pushrod 154, 156, respectively, and may each include a lifter 158, 160. In operation, rotation of the camshaft 130 causes the intake and exhaust lobes 144, 146 to effect translation of the lifters 158, 160 in their respective bores of the engine block 105, which transmits the movement to the pushrods 154, 156. In-turn, the pushrods 154, 156 transmit movement to the rocker arms 138, 140, and therethrough to the intake and exhaust valves 120, 122. In other embodiments, another form of valve lift device may be used for the cam-to-rocker input system 142. For example, direct input may be provided from the intake and exhaust lobes 144, 146 to the rocker arms 138, 140, or input may be provided through intermediate rollers or other devices.

Figure 2:
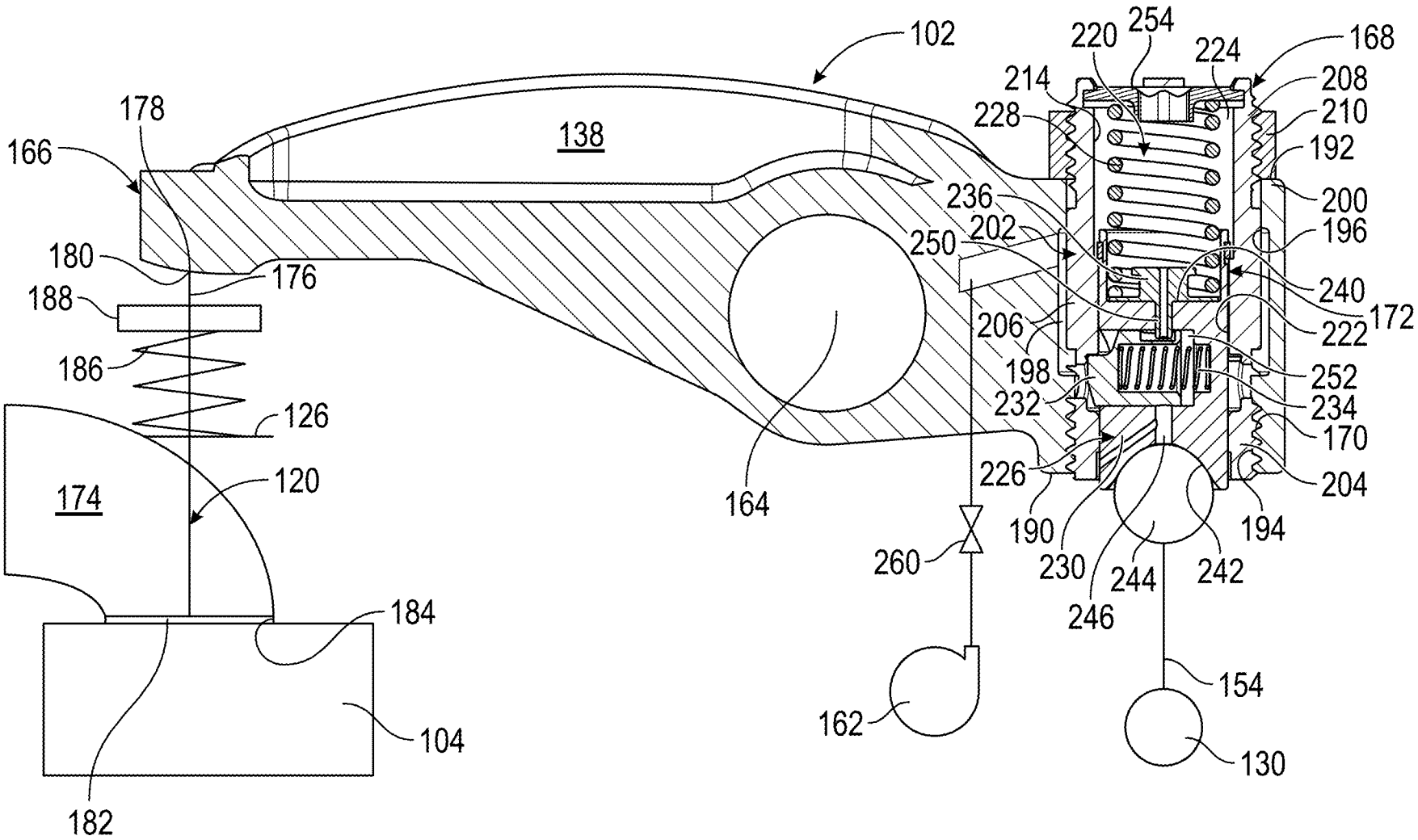
FIG. 2 is a schematic, partially sectioned illustration of the valvetrain deactivation system of the engine of FIG. 1, in accordance with an embodiment.

Referring to FIG. 2, a schematic illustration is provided of aspects of the cylinder deactivation system 102. In this example, the rocker arm 138 and the intake valve 120 are shown but it will be understood that other valves of the engine 100 may be similarly activated and deactivated. The cylinder deactivation system 102 includes the camshaft 130, the cam-to-rocker input system 142, the rocker arm 138, intake valve 120, cylinder 104, valve spring 186 and an engine oil pump 162.

The rocker arm 138 is mounted to move about a pivot point 164. The rocker arm 138 may be mounted on a shaft, pin, stud or other structure. The rocker arm 138 includes a valve end 166 that engages the intake valve 120 and a cam input end 168 that engages with the cam-to-rocker input system 142. The distance from the valve end 166 to the pivot point 164 versus the distance from the cam input end 168 to the pivot point 164 defines a rocker arm ratio. At or adjacent the cam input end 168, the rocker arm 138 defines a bore 170 that houses a deactivation assembly 172. The deactivation assembly 172 operates to alternately transfer motion of the cam-to-rocker input system 142 through the rocker arm 138 to the intake valve 120 in an activated state, or to decouple the motion of the cam-to-rocker input system 142 from the intake valve 120 in a deactivated state. In the activated state, the lift of the cam lobe 144 is transferred to the intake valve 120 to move the intake valve 120 allowing air to flow through the port 174 for generating power in the cylinder 104. In the deactivated state, the intake valve 120 does not move and no work is done in the cylinder 104. The deactivation assembly 172 is housed within the rocker arm 138 at its cam input end 168.

At the valve end 166 of the rocker arm 138, the intake valve 120 includes a stem 176 with a tip 178 that engages the rocker arm 138 at a contact pad 180. The tip 178 of the stem 176 is intended to always remain in contact with the contact pad 180. The intake valve 120 includes a head 182 that alternately seals the port 174 off from the cylinder 104 when on the seat 184 or opens the port 174 to the cylinder 104 when unseated. A spring 186 is disposed around the stem 176 and is compressed between the cylinder head 126 and a retainer 188 fixed to the stem 176. The spring 186 biases the intake valve 120 to a closed position with the head 182 against the seat 184. When the rocker arm 138 is pivoted the contact pad 180 applies force to the tip 178 of the stem 176 compressing the spring 186 and unseating the head 182.

The bore 170 of the rocker arm 138 has a pushrod end 190 and a lash adjustment end 192 opposite the pushrod end 190. The rocker arm 138, within its bore 170, incudes a threaded section 194 at the pushrod end 190 that extends into the bore 170. Next to the threaded section 194 and further into the bore 170 from the pushrod end 190, the bore 170 includes an enlarged section 196 that, in-part, defines a fluid chamber 198. The bore 170 also includes a section 200 that extends from the enlarged section 196 to the lash adjustment end 192. The section 200 is smaller in diameter than the enlarged section 196.

The deactivation assembly 172 includes a lock housing 202 that extends completely through the bore 170. The lock housing 202 includes a threaded segment 204 with threads that thread into the threaded section 194 of the bore 170. The lock housing 202 includes a cylindrical segment 206 that closely fits within the section 200 of the bore 170, optionally with a press fit. The lock housing 202 includes a threaded segment 208 that extends out of the lash adjustment end 192. A nut 210 is threaded onto the threaded segment 208 locking the lock housing 202 in the bore 170.

Figure 3:
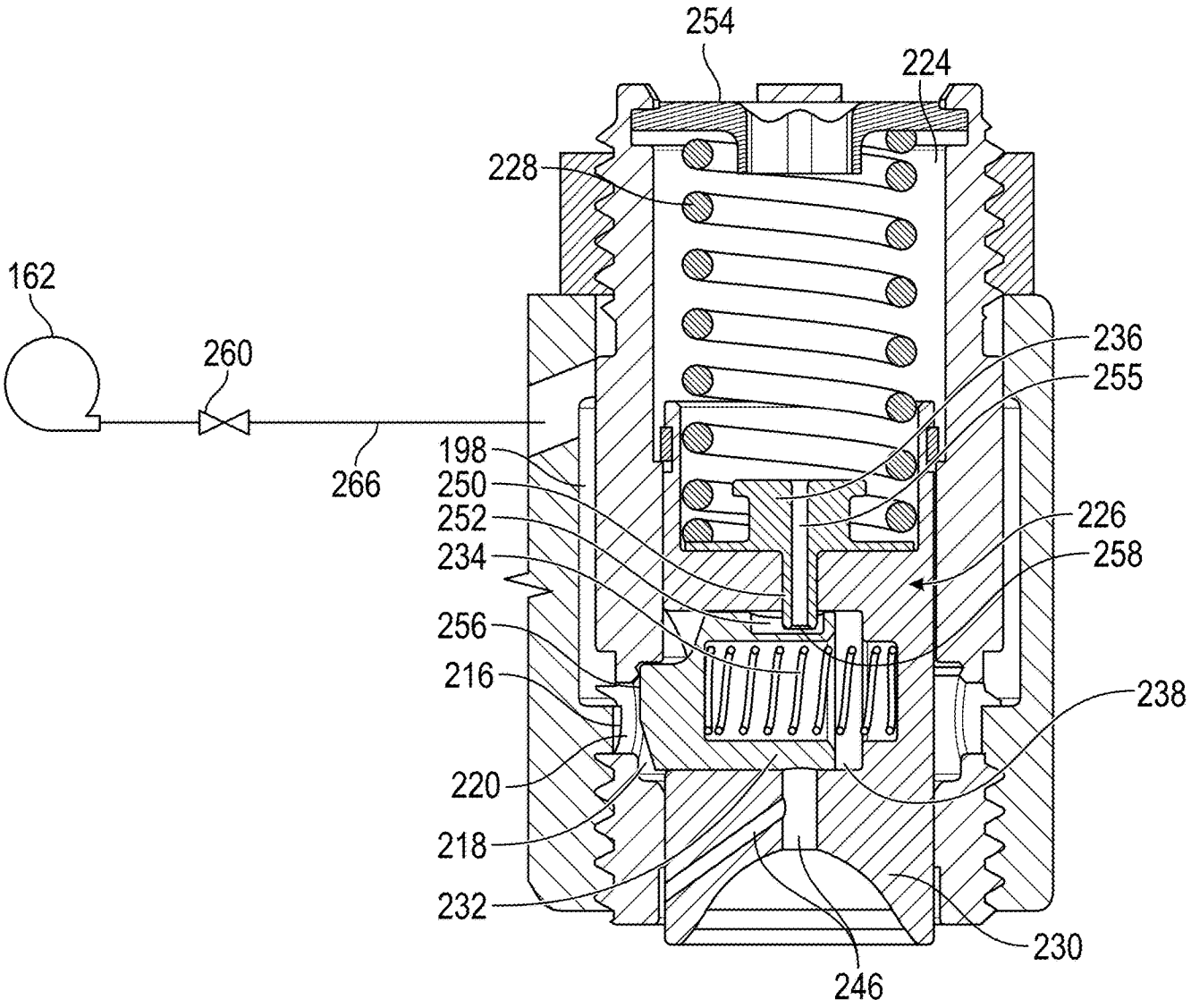
FIG. 3 is a schematic, partially sectioned illustration of a rocker arm of the valvetrain deactivation system of the engine of FIG. 2 in a first state, in accordance with various embodiments.

Referring additionally to FIG. 3, the lock housing 202 has a longitudinal bore 214 that extends completely through and has a cross bore 216 that intersects the longitudinal bore 214 and that registers with the fluid chamber 198. The cross bore 216 is stepped with a larger diameter segment forming an undercut 218 and opening to the longitudinal bore 214 and a smaller diameter segment 220 opening to the fluid chamber 198 and registering with the undercut 218. The smaller diameter segment 220 intersects with the undercut 218 to create an annular flow orifice where pressure may build as further described below. The longitudinal bore 214 defines a lock compartment 222 extending in from the pushrod end 190 and a spring compartment 224 extending in from the lash adjustment end 192. The lock compartment 222 contains a lock assembly 226 and the spring compartment 224 contains a deactivation spring, also referred to as a lost motion spring 228. Depending on the state of the deactivation assembly 172, the lock assembly 226 may extend partly into the spring compartment 224 and/or the lost motion spring 228 may extend partly into the lock compartment 222.

The lock assembly 226 includes a pin housing 230, a lock pin 232, a lock pin spring 234, and a lock pin retainer 236. The pin housing 230 includes a lock pin cavity 238 that contains the lock pin 232 or at least a part thereof, a spring seat 240 in which the lost motion spring 228 is seated, and a pushrod seat 242 in which the pushrod 154 of the cam-to-rocker input system 142 is seated. The pushrod 154 includes a ball 244, that may be an end of the pushrod 154 and with which the pushrod seat 242 is shaped to mate. The pin housing 230 also includes oil galleries 246 for lubrication delivery and/or return purposes. The lock pin retainer 236 retains the lock pin 232 in a proper orientation and location and includes a retaining stem 250 extending into a slot 252 in the lock pin 232. The lock pin retainer 236 also includes an oil gallery 255. The lock pin retainer 236 may also serve as at least a part of the spring seat 240 and the lost motion spring 228 applies a force to maintain the lock pin retainer 236 in position against the pin housing 230.

A spring retainer 254 is fixed at the end of the threaded segment 208, closing the spring compartment 224 and compressing the lost motion spring 228 against the spring seat 240 of the pin housing 230. This holds the pushrod seat 242 against the ball 244 of the pushrod 154. As shown in FIG. 3, the deactivation assembly 172 is shown in a cylinder activated state. Being in an activated state means that the lift of the camshaft 130 is transferred through the cam-to-rocker input system 142, and through the rocker arm 138 to the intake valve 120 causing it to open and close during cycling of the engine 100. The lock pin spring 234 forces the tip 256 of the lock pin 232 into the undercut 218. The tip 256 of the lock pin 232 touches the annular recess in the longitudinal bore 214 prior to the slot 252 contacting the retaining stem 250. The end 258 of the slot 252 may abut against the retaining stem 250 limiting movement of the lock pin 232 and retaining it in the pin housing 230, if needed. The lock pin 232 enters and locks into the undercut 218 locking the pin housing 230 to the lock housing 202 and through the lock housing 202 to the rocker arm 138. The lock pin 232 is forced into the undercut 218 when the engine 100 is operating with all cylinders active. As a result, under action of the pushrod 154, the rocker arm 138 pivots during operation of the engine 100, operating the intake valve 120. The lost motion spring 228 remains in a static state as the pin housing 230 remains in a fixed position relative to the spring retainer 254. In the activated state, oil pressure in the fluid chamber 198 is low or minimal so that the lock pin spring 234 maintains the lock pin 232 in the undercut 218. Pressure from the engine oil pump 162 is controlled to the fluid chamber 198 through a fluid control valve 260 that is moved to a closed position. A reduced oil pump pressure is experienced in fluid chamber 198 due to the fluid control valve 260 when in the closed position.

Figure 4:
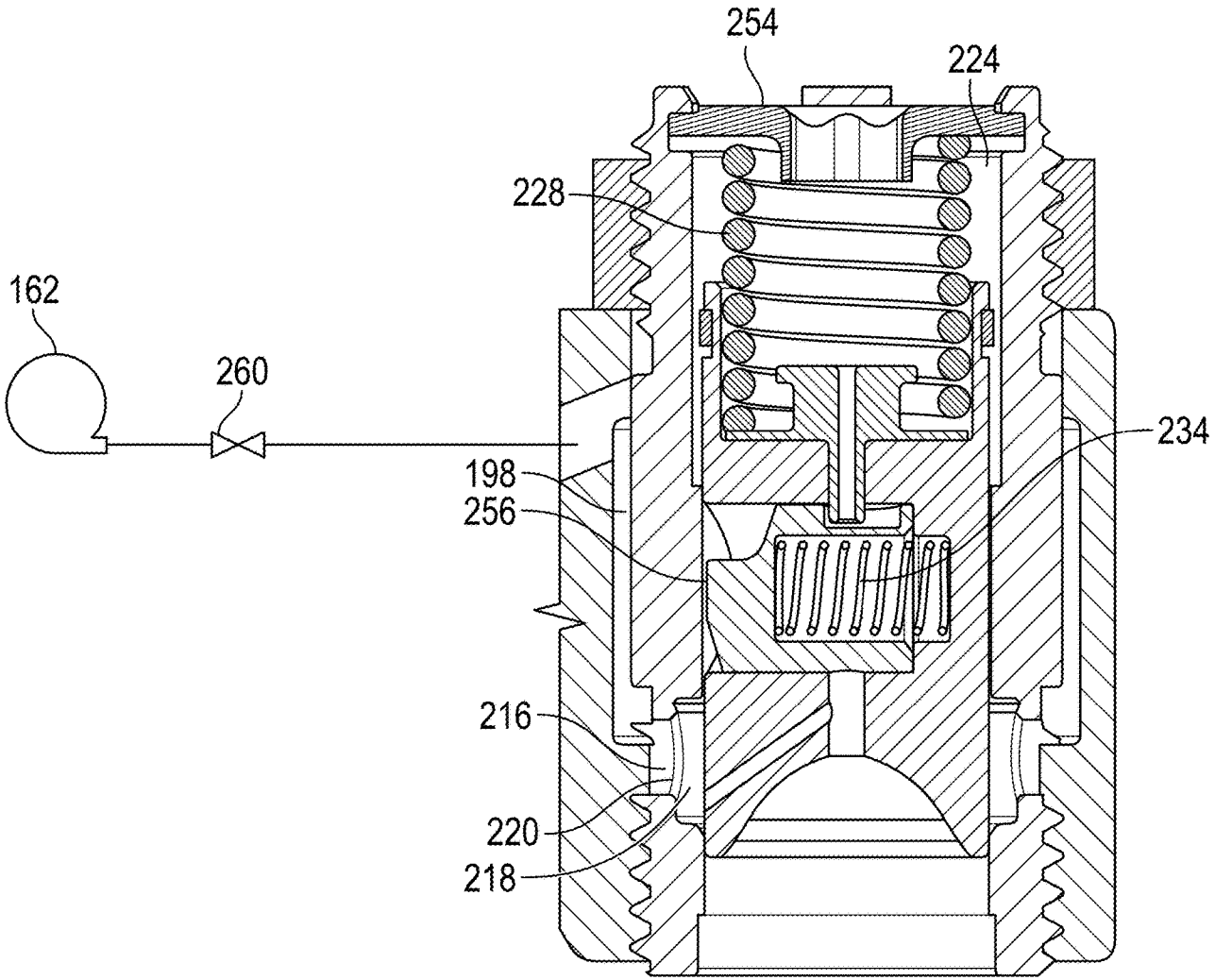
FIG. 4 is a schematic, partially sectioned illustration of a rocker arm of the valvetrain deactivation system of the engine of FIG. 2 in a second state, in accordance with various embodiments.

Referring to FIG. 4, the deactivation assembly 172 is shown in the cylinder deactivated state. Being in a deactivated state means that the lift of the camshaft 130 is transferred through the cam-to-rocker input system 142 to the lock assembly 226 which reciprocates in the rocker arm 138, which does not pivot. The cam lift is not transferred to the intake valve 120 causing it to remain closed during cycling of the engine 100. The smaller diameter segment 220 of the cross bore 216 intersects with the undercut 218 to create an annular flow orifice where pressure may build to result in a force to retract the lock pin 232. As shown in FIG. 4, the lock pin 232 is forced into the lock pin cavity 238 compressing the lock pin spring 234 so that the tip 256 is within the longitudinal bore 214, and specifically within the lock compartment 222 thereof. As a result, the lock assembly 226 is free to move longitudinally, within the longitudinal bore 214 subject to the force applied by the lost motion spring 228. The lock assembly 226 moves in response to input from the pushrod 154. The lock assembly slides/reciprocates in the longitudinal bore 214 compressing and expanding the lost motion spring 228. The valve spring 186 applies a larger force to keep the intake valve 120 closed than the lost motion spring 228 applies to between the retainer 254 and the lock assembly 226, taking into consideration the rocker arm ratio. As a result, the intake valve 120 remains closed and the lock assembly 226 slides in the rocker arm 138, which does not pivot creating a type of lost motion in the valve system 124.

To maintain the lock pin 232 in a retracted position within the lock pin cavity 238, oil pressure is applied through the cross bore 216 toward the lock pin cavity 238. The smaller diameter segment 220 of the cross bore 216 provides an oil passage and oil pressure prevents the lock pin spring 234 from moving the tip 256 into the undercut 218. The lock pin 232 is thus moved out of the undercut 218 compressing the lock pin spring 234, so the lock pin 232 clears out of the undercut 218 and lost motion is achieved. This means that the deactivated state of the intake valve 120 is effected in the rocker arm 138 by oil pressure, in this case from the engine oil pump 162. To effect the deactivated state, the fluid control valve 260 is opened and oil from the pump 162 is delivered through a conduit system 266 to the fluid chamber 198. The fluid chamber 198 is open to the cross bore 216 and its undercut 218 in all cases. Maintaining the fluid control valve 260 in an open condition maintains a high enough pressure in the fluid chamber 198 to overcome the force of the lock pin spring 234 and to prevent the lock pin 232 from moving into the undercut 218. The galleries 246 and 255 ensure no residual pressure occurs in the lock pin cavity 238 to interfere with deactivation.

To return the intake valve 120 to an activated state, the fluid control valve 260 is closed. This regulates the supply of oil pressure to the fluid chamber 198. As a result, the lock pin spring 234 forces the lock pin 232 into the undercut 218 when the two are in registry. The effect is that the rocker arm 138 returns to pivoting in response to the cam-to-rocker input system 142 and the intake valve cycles open and closed. The valves of the engine 100 may be selectively cycled between activated and deactivated states by fluid pressure control through valves, such as the fluid control valve 260. In embodiments, one such valve may be dedicated to a given cylinder, or one valve may be used to control multiple cylinders.

Accordingly, rocker arms may be configured to capture the lift of the engine cam shaft at the area of the rocker arm where the pushrod, or other cam input, contacts it. The internal components of the rocker arm use pressurized engine oil, controlled through a valve to either unlock or lock internal components of the rocker arm to either move within the rocker arm or be fixed to pivot the rocker arm. During unlocked movement of the internal components, the rocker arm does not articulate, and the engine valve doesn't open. This valvetrain deactivating system enables the engine cylinder deactivation capability to be added to an existing engine with minimal changes to the existing engine architecture and with efficient manufacturability. Rocker arms incorporating the elements of the current disclosure may be a direct replacement in the engine, with only internal components being added. Because the deactivation mechanism is located at the top of the engine heads, the disclosed system facilitates servicing a deactivating valve lifter. The system may handle the higher valvetrain loads of a diesel engine similar to current production rocker arms.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing the exemplary embodiment or exemplary embodiments. It should be understood that various changes can be made in the function and arrangement of elements without departing from the scope of the disclosure as set forth in the appended claims and the legal equivalents thereof.

What is claimed is:

1. A cylinder deactivation system for an engine, the cylinder deactivation system comprising:
an engine block defining a cylinder;
a valve configured for opening and closing a port to the cylinder;
a rocker arm including a cam input end and a valve end, the rocker arm configured to pivot about a point between the cam input end and the valve end so as to operate the valve;
a camshaft including a cam lift;
a cam effector configured to transfer the cam lift to the valve via the rocker arm; and
a hydraulically-actuated deactivation assembly disposed in a bore formed at the cam input end of the rocker arm, the deactivation assembly configured to alternately effect an activated state of the valve and a deactivated state of the valve, wherein the deactivation assembly absorbs the cam lift such that the rocker arm does not pivot when in the deactivated state of the valve.

2. The cylinder deactivation system of claim 1, wherein the deactivation assembly includes a pin housing disposed in the bore, and a lock pin disposed in the pin housing, the lock pin configured to alternately lock and unlock the pin housing relative to the rocker arm in response to hydraulic fluid pressure.

3. The cylinder deactivation system of claim 1, wherein the valve includes a valve spring configured to apply a first force which biases the valve to a closed position, wherein the deactivation assembly includes a deactivation spring disposed in the bore, the deactivation spring configured to apply a second force in the deactivation assembly, and wherein the first force is greater than the second force such that the valve spring maintains the valve in the closed position when the deactivation spring is compressed in the deactivated state of the valve.

4. The cylinder deactivation system of claim 1, wherein the bore is a first bore, and
wherein the deactivation assembly includes:
a lock housing disposed in the first bore, the lock housing defining a cross bore;
a pin housing disposed within the lock housing, the pin housing defining a lock pin cavity that communicates with the cross bore;
a lock pin disposed in the lock pin cavity; and
a pump configured to selectively supply hydraulic fluid pressure to the cross bore so as to force the lock pin into the lock pin cavity.

5. The cylinder deactivation system of claim 1, wherein bore is a first bore, and
wherein the deactivation assembly includes:
a lock housing disposed in the first bore, the lock housing defining a cross bore;
a pin housing disposed within the lock housing, the pin housing defining a lock pin cavity;
a lock pin disposed in the lock pin cavity; and
a lock pin spring disposed in the lock pin cavity so as to bias the lock pin toward the cross bore, the lock pin spring configured to be compressed via hydraulic fluid pressure when in the deactivated state of the valve.

6. The cylinder deactivation system of claim 1, wherein the deactivation assembly includes:
a pin housing disposed in the bore, the pin housing defining a lock pin cavity;
a lock pin disposed in the lock pin cavity, the lock pin including a slot; and
a lock pin retainer including a stem engaged in the slot.

7. The cylinder deactivation system of claim 1, wherein the deactivation assembly includes:
a pin housing disposed in the bore, the pin housing defining a lock pin cavity;
a lock pin disposed in the lock pin cavity; and
an oil gallery which opens to the lock pin cavity so as to relieve hydraulic pressure from the lock pin cavity.

8. The cylinder deactivation system of claim 1, wherein the deactivation assembly includes:
a pin housing disposed in the bore, the pin housing defining a lock pin cavity;
a lock pin disposed in the lock pin cavity; and
a deactivation spring disposed in the bore so as to apply a force to the pin housing.

9. The cylinder deactivation system of claim 1, wherein the bore is a first bore, and
wherein the deactivation assembly includes:
a lock housing disposed in the first bore, the lock housing defining a cross bore including an undercut;
a pin housing disposed within the lock housing, the pin housing defining a lock pin cavity;
a lock pin disposed in the lock pin cavity; and
a lock pin spring disposed in the lock pin cavity, the lock pin spring configured to bias the lock pin into the undercut of the cross bore so as to effect the activated state of the valve.

10. The cylinder deactivation system of claim 1, wherein the deactivation assembly includes:
a pin housing disposed in the bore, the pin housing defining a seat configured to engage the cam effector; and
a deactivation spring disposed in the bore, the deactivation spring serving as a lost motion spring which absorbs the cam lift such that the valve does not open when in the deactivated state of the valve.

11. A cylinder deactivation system for an engine, the cylinder deactivation system comprising:
an engine block defining a cylinder;
a valve configured for opening and closing a port to the cylinder;
a rocker arm including a cam input end and a valve end, the rocker arm configured to pivot about a point between the cam input end and the valve end so as to operate the valve;
a camshaft including a cam lift;
a cam effector configured to transfer the cam lift to the valve via the rocker arm; and
a hydraulically-actuated deactivation assembly disposed in a bore formed at the cam input end of the rocker arm, the deactivation assembly including a lock pin configured to alternately lock and unlock the rocker arm from pivoting so as to respectively effect an activated state of the valve and a deactivated state of the valve,
wherein the deactivation assembly absorbs the cam lift such that the rocker arm does not pivot when in the deactivated state of the valve.

12. The cylinder deactivation system of claim 11, wherein the deactivation assembly includes a pin housing disposed in the bore, the pin housing configured to receive the lock pin such that the alternating locking and unlocking of the rocker arm is effected when the lock pin respectively locks and unlocks the pin housing relative to the rocker arm in response to hydraulic fluid pressure.

13. The cylinder deactivation system of claim 11, wherein:
the valve includes a valve spring configured to apply a first force which biases the valve to a closed position, the deactivation assembly includes a deactivation spring disposed in the bore, the deactivation spring configured to apply a second force in the deactivation assembly, and the first force is greater than the second force such that the valve spring maintains the valve in the closed position when the deactivation spring is compressed in the deactivated state of the valve.

14. The cylinder deactivation system of claim 11, wherein the bore is a first bore, and wherein the deactivation assembly further includes:

a lock housing disposed in the first bore, the lock housing defining a cross bore;

a fluid chamber defined in the rocker arm so as to communicate with the cross bore;

a pin housing disposed within the lock housing, the pin housing defining a lock pin cavity which receives the lock pin and communicates with the cross bore;

a pump configured to supply hydraulic fluid pressure to the cross bore via the fluid chamber so as to force the lock pin into the lock pin cavity; and a fluid control valve configured to control delivery of the hydraulic fluid pressure from the pump to the cross bore.

15. The cylinder deactivation system of claim 11, wherein the bore is a first bore, and wherein the deactivation assembly further includes:

a lock housing disposed in the first bore, the lock housing defining a cross bore;

a pin housing within the lock housing, the pin housing defining a lock pin cavity which receives the lock pin, and;

a lock pin spring disposed in the lock pin cavity so as to bias the lock pin toward the cross bore, the lock pin spring configured to be compressed via hydraulic pressure when in the deactivated state of the valve.

16. The cylinder deactivation system of claim 11, wherein the deactivation assembly further includes:

a pin housing disposed in the bore, the pin housing defining a lock pin cavity which receives the lock pin;

a slot formed in the lock pin;

a lock pin retainer including a retaining stem engaged in the slot, and an oil gallery extending through the retaining stem.

17. The cylinder deactivation system of claim 11, wherein the deactivation assembly further includes:

a pin housing disposed in the bore, the pin housing defining a lock pin cavity which receives the lock pin; and an oil gallery extending through the pin housing to the lock pin cavity so as to relieve hydraulic pressure from the lock pin cavity.

18. The cylinder deactivation system of claim 11, wherein the deactivation assembly further includes:

a pin housing disposed in the bore, the pin housing defining a lock pin cavity which receives the lock pin;

a lock pin spring disposed in the lock pin cavity; and a deactivation spring disposed in the bore so as to apply a force to the pin housing.

19. The cylinder deactivation system of claim 11, wherein the bore is a first bore, and wherein the deactivation assembly further includes:

a lock housing disposed in the first bore, the lock housing defining a cross bore including an undercut;

a pin housing disposed within the lock housing, the pin housing defining a lock pin cavity which receives the lock pin;

a lock pin spring disposed in the lock pin cavity, the lock pin spring configured to bias the lock pin into the undercut of the cross bore so as to effect the activated state of the valve; and a lock pin retainer including a stem engaging the lock pin.

20. A cylinder deactivation system for an engine, the cylinder deactivation system comprising:

an engine block defining a cylinder;

a valve configured for opening and closing a port to the cylinder;

a rocker arm including a cam input end and a valve end, the rocker arm configured to pivot about a point between the cam input end and the valve end so as to operate the valve;

a camshaft including a cam lift;

a cam effector configured to transfer the cam lift to the valve via the rocker arm; and a hydraulically actuated deactivation assembly disposed in a bore formed at the cam input end of the rocker arm, the deactivation assembly including:

a lock pin configured to alternately lock and unlock the rocker arm from pivoting so as to respectively effect an activated state of the valve and a deactivated state of the valve, and a deactivation spring disposed in the bore, the deactivation spring serving as a lost motion spring which absorbs the cam lift such that the rocker arm does not pivot and the valve does not open when in the deactivated state of the valve.

* * * * *